US008234899B1

(12) United States Patent
Chuang

(10) Patent No.: US 8,234,899 B1
(45) Date of Patent: Aug. 7, 2012

(54) ROLL-FORMING MACHINE FOR FORMING C-SHAPED/Z-SHAPED COMPONENTS

(76) Inventor: Sen-Jung Chuang, Taipei County (TW)

( * ) Notice: Subject to any disclaimer, the term of this patent is extended or adjusted under 35 U.S.C. 154(b) by 484 days.

(21) Appl. No.: 12/638,688

(22) Filed: Dec. 15, 2009

(51) Int. Cl.
*B21D 5/14* (2006.01)
*B21D 5/16* (2006.01)

(52) U.S. Cl. ..... 72/179; 72/181

(58) Field of Classification Search ..... 72/176, 72/178–182
See application file for complete search history.

(56) References Cited

U.S. PATENT DOCUMENTS

| | | | | |
|---|---|---|---|---|
| 6,148,654 | A * | 11/2000 | Jensen et al. | 72/181 |
| 6,434,994 | B2 * | 8/2002 | Bradbury et al. | 72/178 |
| 7,111,481 | B2 * | 9/2006 | Green et al. | 72/11.2 |
| 7,207,201 | B1 * | 4/2007 | Chuang | 72/131 |
| 7,231,796 | B1 * | 6/2007 | Chuang | 72/181 |
| 7,243,519 | B1 * | 7/2007 | Chuang | 72/181 |
| 2001/0011468 | A1 * | 8/2001 | Bradbury et al. | 72/178 |
| 2005/0178181 | A1 * | 8/2005 | Green et al. | 72/181 |
| 2005/0252265 | A1 * | 11/2005 | McDonald | 72/181 |
| 2006/0272376 | A1 * | 12/2006 | Green et al. | 72/181 |
| 2008/0216541 | A1 * | 9/2008 | Fudulu et al. | 72/181 |
| 2010/0139350 | A1 * | 6/2010 | Smith et al. | 72/11.2 |
| 2011/0247384 | A1 * | 10/2011 | Bartlett et al. | 72/181 |

* cited by examiner

*Primary Examiner* — Edward Tolan
*Assistant Examiner* — Lawrence J Averick
(74) *Attorney, Agent, or Firm* — Jackson IPG PLLC

(57) ABSTRACT

In a roll-forming machine having pairs of forming roll sets and two first and two second auxiliary shape-forming wheel sets for processing C-shaped component or Z-shaped component, each first auxiliary shape-forming wheel set having, in addition to an upper auxiliary shape-forming wheel, a bottom auxiliary wheel for working with a respective lateral shape-forming wheel to ram each of two sides of a C-shaped or Z-shaped component into a 90° contained angle, and each second auxiliary shape-forming wheel set having, in addition to an upper auxiliary shape-forming wheel, a bottom auxiliary wheel for working with a respective lateral shape-forming wheel to ram each of two sides of a C-shaped or Z-shaped component into a 90° contained angle, so that the operator needs not to shut down the machine or to change or calibrate the machine parts when wishing to change the processing from a C-shaped component processing mode to a Z-shaped component processing mode or from a Z-shaped component processing mode to a C-shaped component processing mode.

9 Claims, 20 Drawing Sheets

ROLL-FORMING MACHINE FOR FORMING C-SHAPED/Z-SHAPED COMPONENTS

BACKGROUND OF THE INVENTION

1. Field of the Invention

The present invention relates to a roll-forming machine and more particularly, to an improved structure of roll-forming machine, which allows formation of a C-shaped component as well as a Z-shaped selectively during operation without changing or adjusting the machine parts, thereby facilitating the production and saving much the labor and fabrication time.

2. Description of the Related Art

A roll-forming machine for transforming a planar sheet of metal into a component having either a C-shaped or Z-shaped cross-sectional area is known having two first auxiliary shape-forming wheel sets and two second auxiliary shape-forming wheel sets arranged near the rear side of the machine base. The first auxiliary shape-forming wheel sets and the second auxiliary shape-forming wheel sets are adapted to ram two sides of each fed component into a 90-degree contained angle. As shown in FIGS. 1 and 2, the two second auxiliary shape-forming wheel sets 91 and 92 are adapted to ram each of the two sides of a C-shaped component 93 into a 90-degree contained angle. When wishing to ram each of the two sides of a Z-shaped component 94 into a 90-degree contained angle, the second auxiliary shape-forming wheel set 92 must be removed from the machine base and replaced with another specification of second auxiliary shape-forming wheel set 95 and one first auxiliary shape-forming wheel set (not shown) also must be removed from the machine base and replaced with another specification of fist auxiliary shape-forming wheel set. When changing the operation between a C-shaped component processing mode and a Z-shaped component processing mode, the roll-forming machine must be shut down and the related machine parts must be detached for a replacement, wasting much labor and time.

U.S. Pat. No. 7,231,796B1, issued to the present inventor, discloses a roll-forming machine, entitled "structure of roll-forming machine", which has an adjustment structure for adjusting the horizontal pitch between the left-side forming rolls and the right-side forming rolls, the vertical pitch between the first left-side forming toll and the second left-side and the vertical pitch between the first right-side forming roll and the second right-side forming roll, and the pitch between the impression roll and sheet-transfer roll of each sheet-transfer roll set. This design is relatively complicated, requiring photoelectric sensor means at each arbor to control accuracy of angle adjustment.

SUMMARY OF THE INVENTION

The present invention has been accomplished under the circumstances in view. It is therefore the main object of the present invention to provide a roll-forming machine, which eliminates the aforesaid drawbacks.

According to the present invention, each of the first and second auxiliary shape-forming wheel sets comprises a bottom wheel holder provided at a lower part of the rack thereof, a bottom auxiliary wheel pivoted to the bottom wheel holder of for working with a lower part of the lateral shape-forming wheel thereof. By means of the arrangement of the bottom wheels of the first and second auxiliary shape-forming wheel sets, the roll-forming machine can ram each of the two sides of a C-shaped component as well as each of the two sides of a Z-shaped component into a 90° contained angle without changing or adjusting the machine parts.

DETAILED DESCRIPTION OF THE INVENTION

Figure 1:
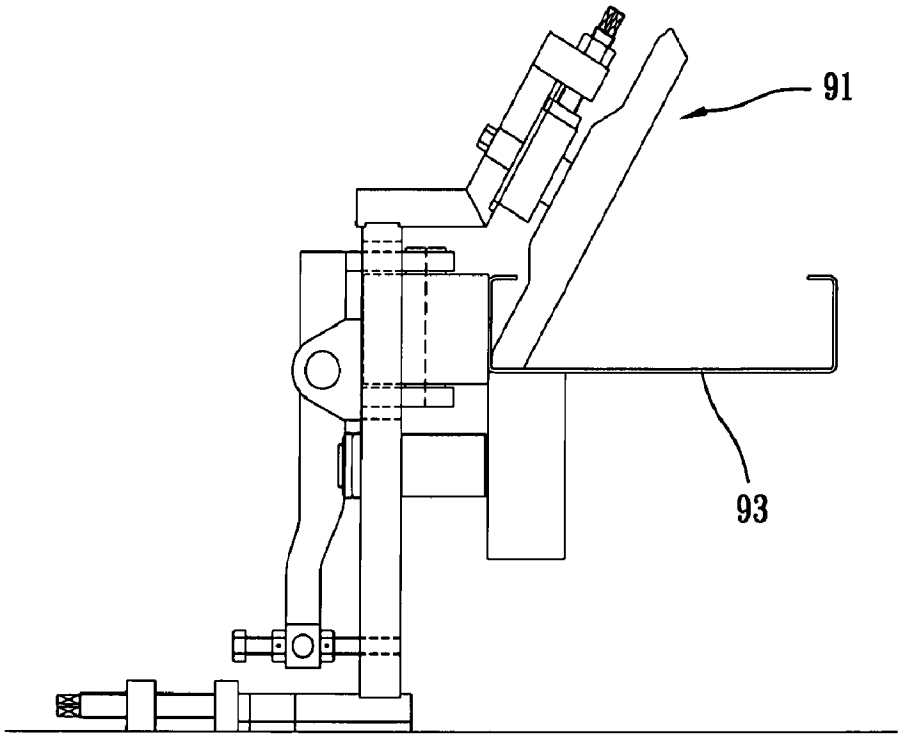
Fig. 1 PRIOR ART
FIG. 1 is a plain view of one of two second auxiliary shape-forming wheel sets of a roll-forming machine according to the prior art.
Figure 2:
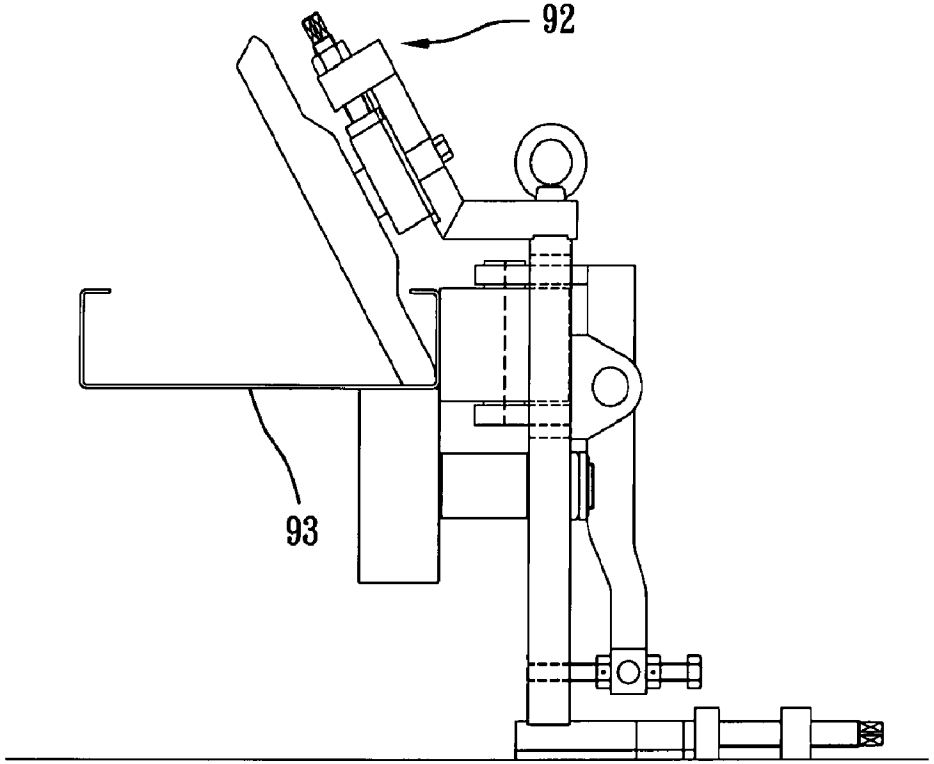
Fig. 2 PRIOR ART
FIG. 2 is a plain view of the other of the two second auxiliary shape-forming wheel sets of a roll-forming machine according to the prior art.
Figure 3:
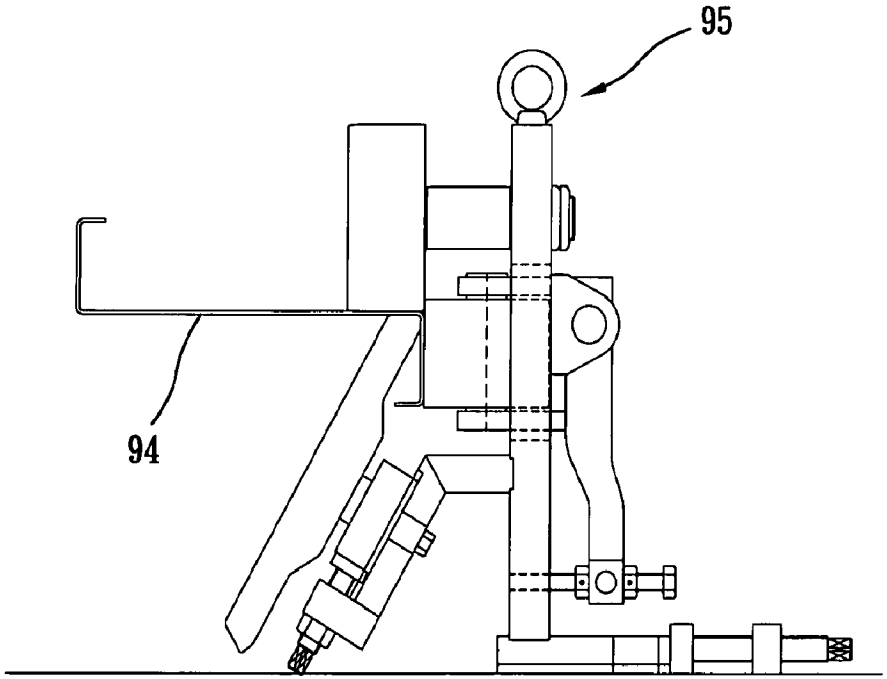
Fig. 3 PRIOR ART
FIG. 3 is a plain view of the prior art roll-forming machine, showing the other second auxiliary shape-forming wheel set replaced with another specification of second auxiliary shape-forming wheel set.

Referring to FIGS. 4 through 20, a roll-forming machine in accordance with the present invention is shown adapted to facilitate the formation of either a C-shaped component or a Z-shaped component selectively from a sheet of material. The roll-forming machine comprises a guide block unit 1 provided at the front top side of the machine base 2 thereof for guiding a sheet material 70 to the machine base 2 for processing, and pairs of forming roll sets 3.

Figure 5:
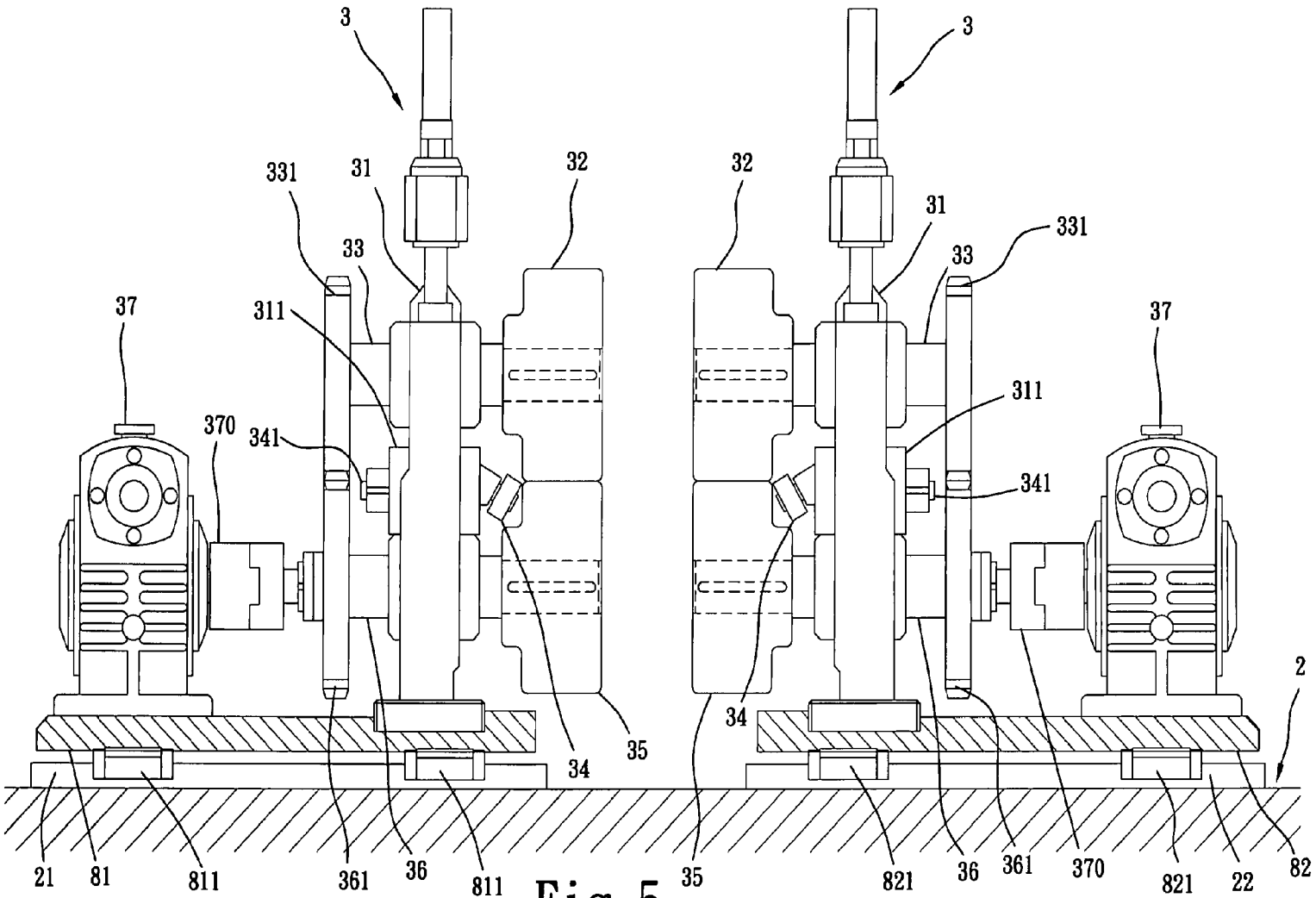
FIG. 5 is an enlarged view in section of a part of the roll-forming machine according to the present invention, showing the arrangement of one pair of forming roll sets on the machine base.
Figure 6:
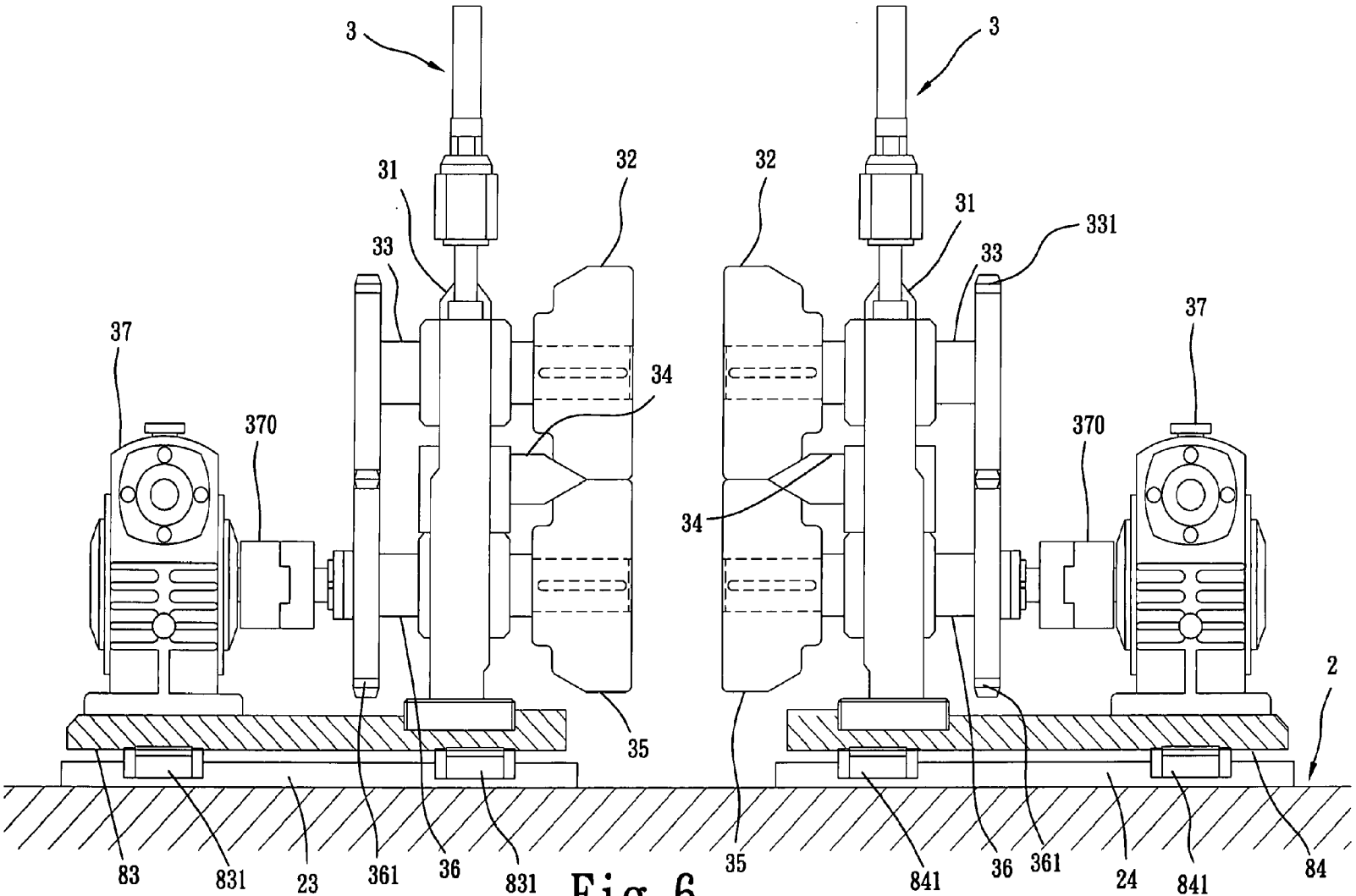
FIG. 6 corresponds to FIG. 5 when viewed from another side.

The number of the pairs of forming roll sets 3 is 15 numbered from the 1st through the 15th. As shown in FIGS. 5 and 6, each forming roll set 3 comprises a rack 31, a first shaft 33 and a second shaft 36 pivotally mounted in the rack 31 in horizontal at different elevations, an impression wheel 32 fixedly mounted on one end of the first shaft 33, a first gear wheel 331 fixedly mounted on the other end of the first shaft 33, a sheet-transfer wheel 35 fixedly mounted on one end of the second shaft 36 corresponding to the impression wheel 32, a second gear wheel 361 fixedly mounted on the other end of the second shaft 36 and meshed with the first gear wheel 331, a shape-forming wheel 34, which has a wheel shaft 341 pivotally mounted in a wheel holder 311 at the rack 31 and is adapted to ram the sheet material 70 being delivered through the gap between the impression wheel 32 and the sheet-transfer wheel 35 into a predetermined shape (see FIGS. 4~6), a reduction gear box 37, and a coupling 370 coupled between the output side of the reduction gear box 37 and the second shaft 36. Upon rotation of the second shaft 36 by the reduction gear box 37 through the coupling 370, the sheet-transfer wheel 35 and the second gear wheel 361 are rotated with the second shaft 36, and the first gear wheel 331 is driven by the second gear wheel 361 to rotate the first shaft 33 and the impression wheel 32. The roll-forming machine further comprises two motors adapted to drive the reduction gear boxes 37 of the forming roll sets 3.

The two racks 31 of each pair of forming roll sets 3 are respectively mounted on a first left-side carrier plate 81 and second left-side carrier plate 83, and a first right-side carrier plate 82 and second right-side carrier plate 84. The first left-side carrier plate 81 and the first right-side carrier plate 82 have the respective bottom side respectively mounted with slides 811, 821 that are respectively coupled to a left-side rail 21 and a right-side rail 22 at the top side of the machine base 2; the second left-side carrier plate 83 and the second right-side carrier plate 84 have the respective bottom side respectively mounted with slides 831, 841 that are respectively coupled to a left-side rail 23 and a right-side rail 24 at the rear side of the machine base 2.

Figure 4:
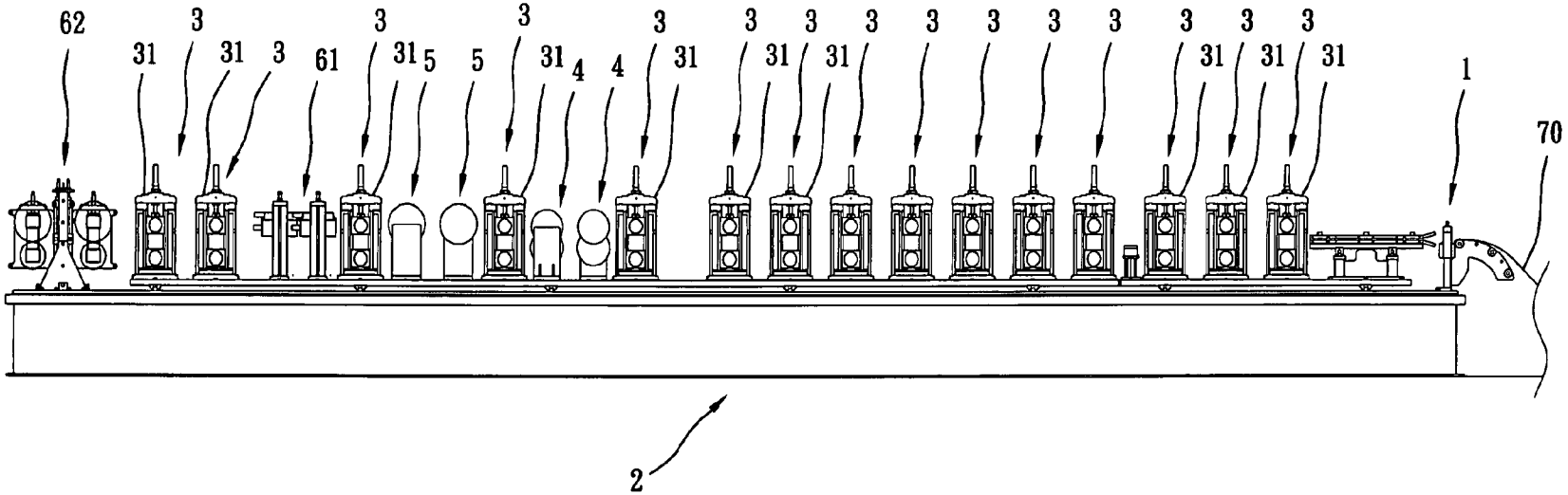
FIG. 4 is a plain view of one of a roll-forming machine according to the present invention.

Referring to FIGS. 7~11, two first auxiliary shape-forming wheel sets 4 are respectively mounted on the second left-side carrier plate 83 and the second right-side carrier plate 84 at the top side of the machine base 2 between pairs of forming roll sets 3 near the rear side of the machine base 2 (see FIG. 4). According to this embodiment, the two first auxiliary shape-forming wheel sets 4 are set between the $11^{th}$ pair of forming roll sets 3 and the $12^{th}$ pair of forming roll sets 3 (see FIG. 4). Each first auxiliary shape-forming wheel set 4 comprises a rack 41, an upper wheel holder 42, which is provided at the top side of the rack 41 and has a sliding groove 421 and a screw hole 420, a sliding block 43 slidably coupled to the sliding groove 421, a lock screw 431 for locking the sliding block 43 to the upper wheel holder 42 (see FIG. 17), a connection block 424, which is fastened to a screw hole 430 on one side of the sliding block 43 with a screw bolt 425 and defines therein a locating groove 4241, an adjustment screw 422, which has a threaded shank 4221 threaded into the screw hole 420 of the upper wheel holder 42 and a head 4222 positioned in the locating groove 4241 of the connection block 424, and a nut 426 threaded onto the threaded shank threaded shank 4221 of the adjustment screw 422 to secure the adjustment screw 422 to the wheel holder 42. When unfastened the lock screw 431 (see FIG. 7), the user can rotate the adjustment screw 422 to move the sliding block 43 along the sliding groove 421 to the desired position. Each first auxiliary shape-forming wheel set 4 further comprises an upper auxiliary shape-forming wheel 44 that is pivoted to the sliding block 43 with a pivot 432, an adjustable lateral wheel holder 45 provided laterally at the rack 41, a lateral shape-forming wheel 46 pivoted to the adjustable lateral wheel holder 45, and a locating block 47 fixedly provided at the bottom side of the rack 41 and affixed to the first left-side carrier plate 81 or second left-side carrier plate 83. The upper auxiliary shape-forming wheel 44 has a flat circular bottom surface 441, a beveled peripheral surface 442 extending around the flat circular bottom surface 441, a flat annular top surface 444, a chamfered annular surface 443 connected between the beveled peripheral surface 442 and the flat annular top surface 444. The lateral shape-forming wheel 46 has a conical work surface 461. By means of the two first auxiliary shape-forming wheel sets 4, the bottom of a C-shaped component 71 is rammed into a 90-degree contained angle (see FIGS. 8 and 9).

Referring to FIGS. 12~16, two second auxiliary shape-forming wheel sets 5 are respectively mounted on the second left-side carrier plate 83 and the second right-side carrier plate 84 at the top side of the machine base 2 between pairs of forming roll sets 3 near the rear side of the machine base 2 (see FIG. 4). According to this embodiment, the two second auxiliary shape-forming wheel sets 5 are set between the $12^{th}$ pair of forming roll sets 3 and the $13^{th}$ pair of forming roll sets 3 (see FIG. 4). Each second auxiliary shape-forming wheel set 5 comprises a rack 51, an upper wheel holder 52, which is provided at the top side of the rack 51 and has a sliding groove 521 and a screw hole 520, a sliding block 53 slidably coupled to the sliding groove 521, a lock screw 531 for locking the sliding block 53 to the upper wheel holder 52 (see FIG. 18), a connection block 524, which is fastened to a screw hole 530 on one side of the sliding block 53 with a screw bolt 525 and defines therein a locating groove 5241, an adjustment screw 522, which has a threaded shank 5221 threaded into the screw hole 520 of the upper wheel holder 52 and a head 5222 positioned in the locating groove 5241 of the connection block 524, and a nut 526 threaded onto the threaded shank threaded shank 5221 of the adjustment screw 522 to secure the adjustment screw 522 to the wheel holder 52. When unfastened the lock screw 531 (see FIG. 12), the user can rotate the adjustment screw 522 to move the sliding block 53 along the sliding groove 521 to the desired position. Each second auxiliary shape-forming wheel set 5 further comprises an upper auxiliary shape-forming wheel 54 that is pivoted to the sliding block 53 with a pivot 532, an adjustable lateral wheel holder 55 provided laterally at the rack 51, a lateral shape-forming wheel 56 pivoted to the adjustable lateral wheel holder 55, and a locating block 57 fixedly provided at the bottom side of the rack 51 and affixed to the first left-side carrier plate 81 or second left-side carrier plate 83. The upper auxiliary shape-forming wheel 54 has a flat circular bottom surface 541, a beveled peripheral surface 542 extending around the flat circular bottom surface 541, a flat annular top surface 544, a chamfered annular surface 543 connected between the beveled peripheral surface 542 and the flat annular top surface 544. The lateral shape-forming wheel 56 has a flat work surface 561. By means of the two second auxiliary shape-forming wheel sets 5, the bottom of a C-shaped component 71 is rammed into a 90-degree contained angle (see FIGS. 13 and 14).

A small straightener 61 is set between the 13$^{th}$ pair of forming roll sets 3 and the 14$^{th}$ pair of forming roll sets 3 and adapted to straighten the wall of a C-shaped component 71 or Z-shaped component 72.

A big straightener 62 is set at the rear side of the machine base 2 and adapted to straighten the wall of a C-shaped component 71 or Z-shaped component 72.

When a sheet material 70 is guided by the guide block unit 1 into the machine base 2, the impression wheels 32 and sheet-transfer wheels 35 of the forming roll sets 3 move the sheet material 70 forwards for processing by the shape-forming wheels 34 (see FIGS. 5 and 6), the first auxiliary shape-forming wheel sets 4 (see FIGS. 7~9) and the second auxiliary shape-forming wheel sets 5 (see FIGS. 12~14) into the desired shape and for further straightening by the small straightener 61 and the big straightener 62.

Figure 10:
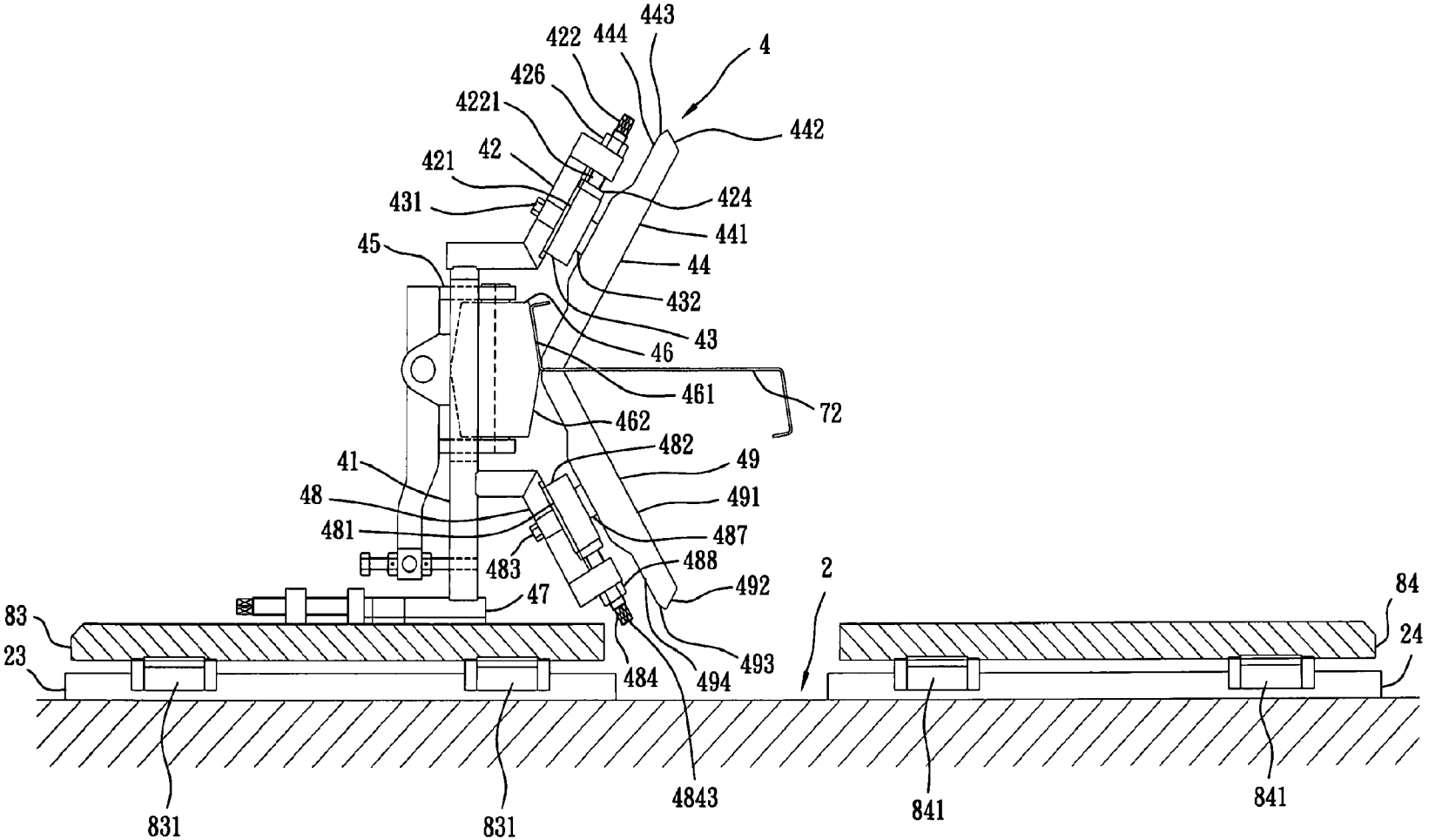
FIG. 10 corresponds to FIG. 7, showing the other operation status of the first auxiliary shape-forming wheel set.
Figure 11:
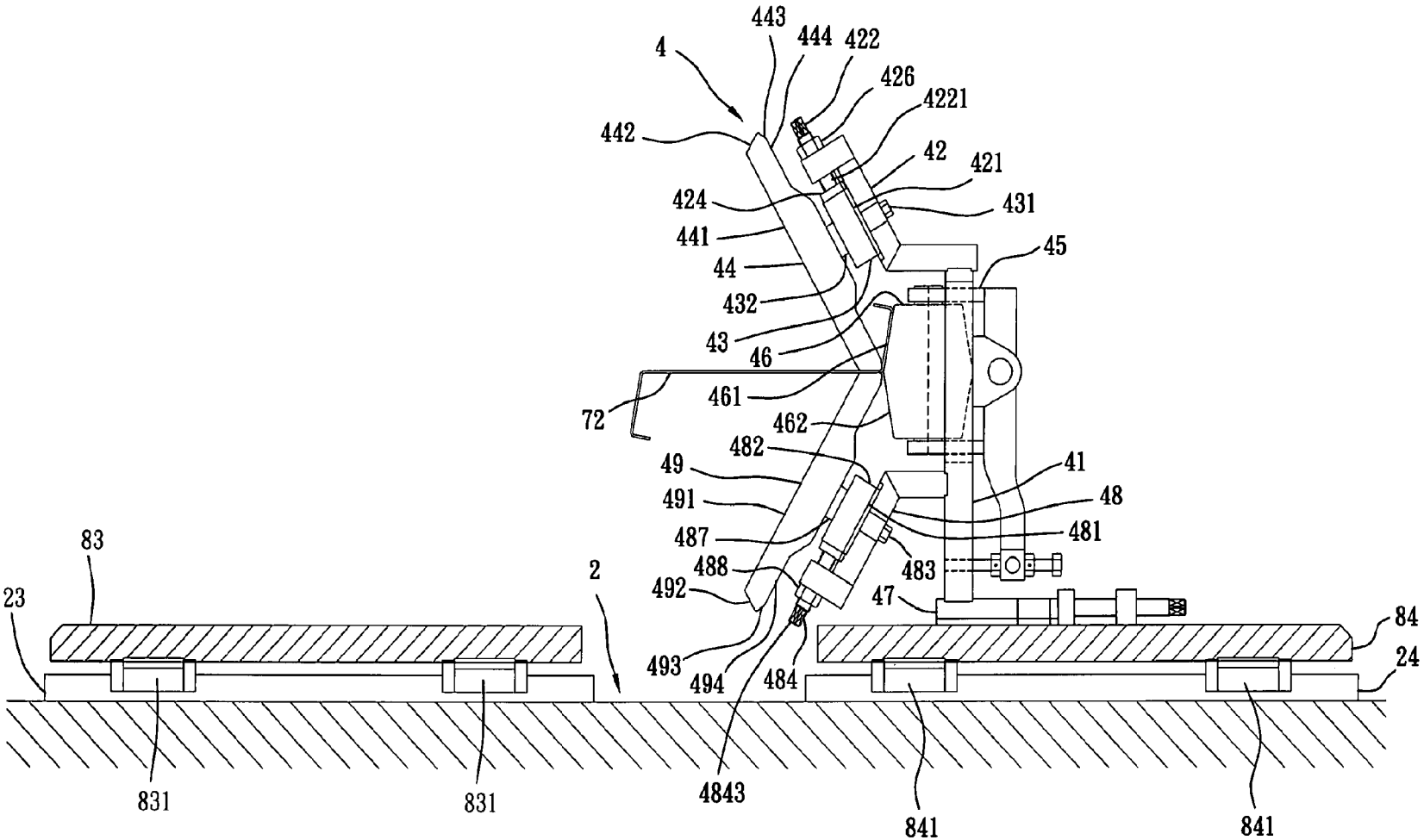
FIG. 11 corresponds to FIG. 9, showing the other operation status of the first auxiliary shape-forming wheel set.

The roll-forming machine is characterized in that:

Each first auxiliary shape-forming wheel set 4 further comprises a bottom wheel holder 48 (see FIGS. 7~11) provided at the lower part of the rack 41, a first bottom auxiliary wheel 49 pivoted to the bottom wheel holder 48 for working with the lower part 462 of the conical work surface 461 of the lateral shape-forming wheel 46 to ram each of two sides of a Z-shaped component 72 into a 90° contained angle (see FIGS. 10 and 11).

Figure 15:
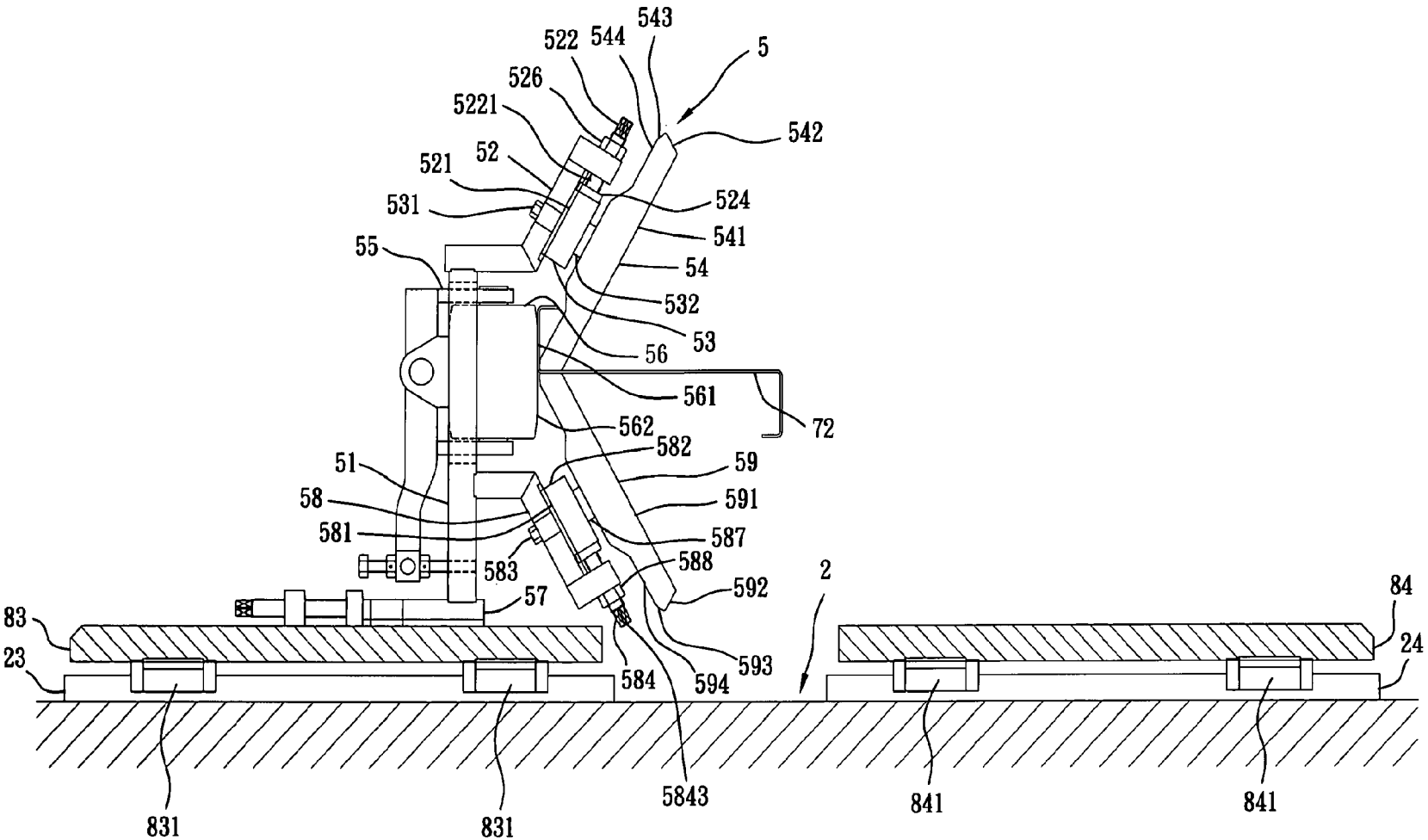
FIG. 15 corresponds to FIG. 13, showing the other operation status of the second auxiliary shape-forming wheel set.
Figure 16:
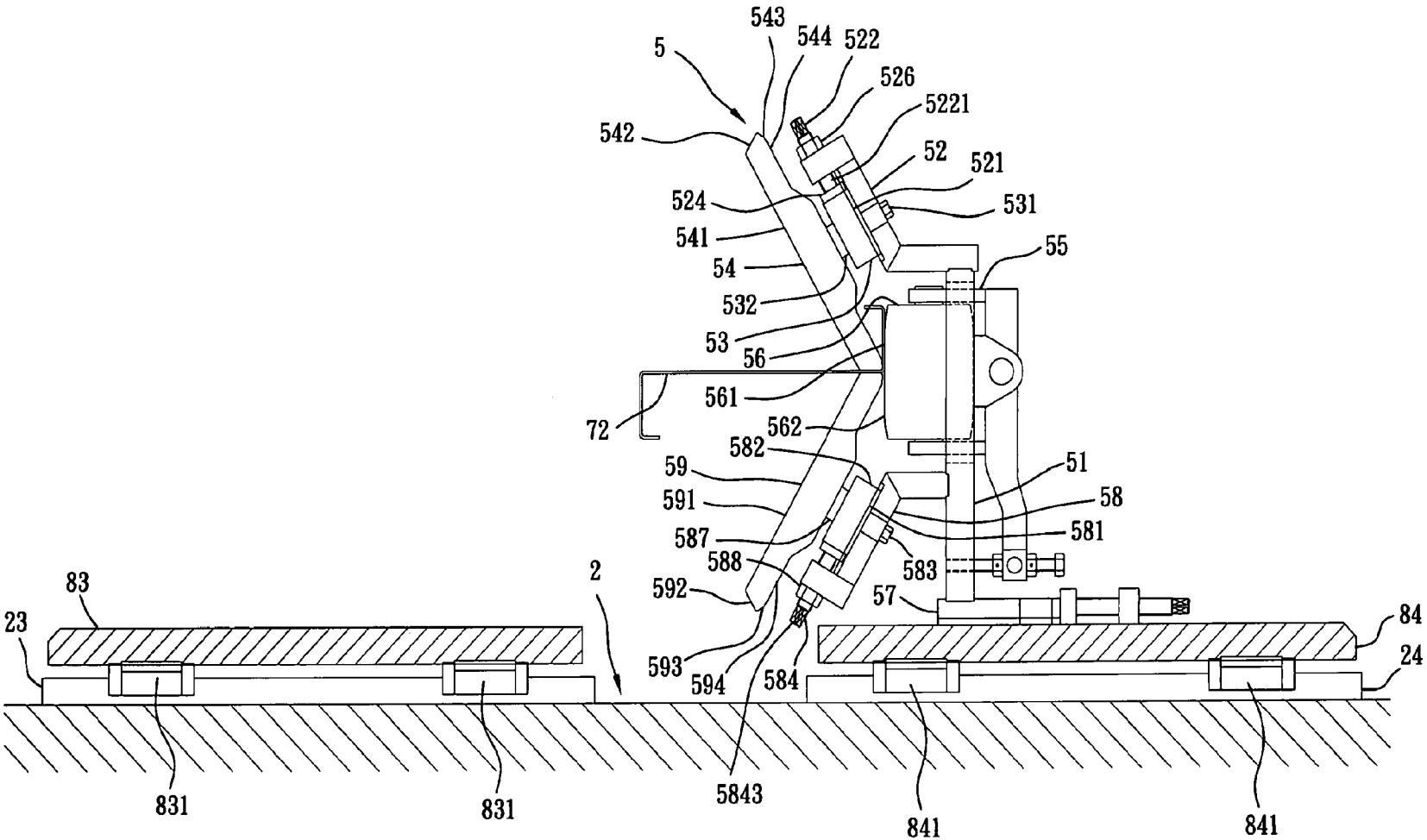
FIG. 16 corresponds to FIG. 14, showing the other operation status of the second auxiliary shape-forming wheel set.
Figure 17:
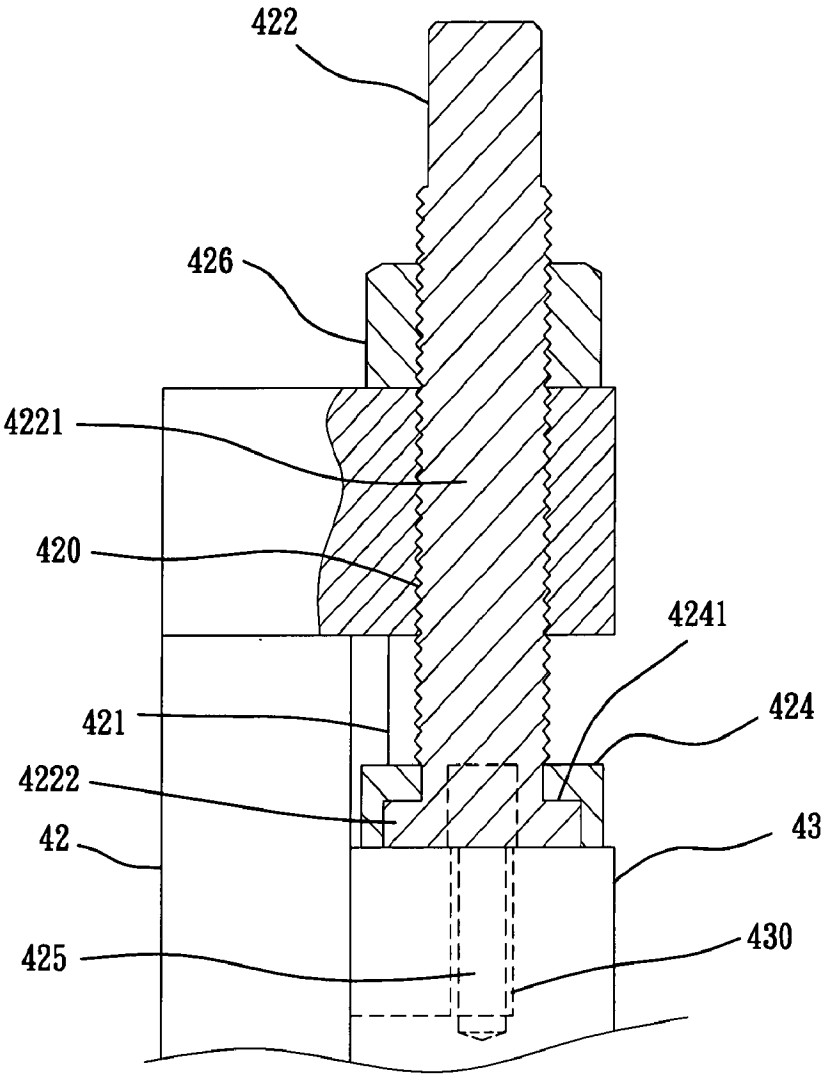
FIG. 17 is an enlarged view in section of a part of the present invention, showing the arrangement of the upper wheel holder of one fist auxiliary shape-forming wheel set.
Figure 18:
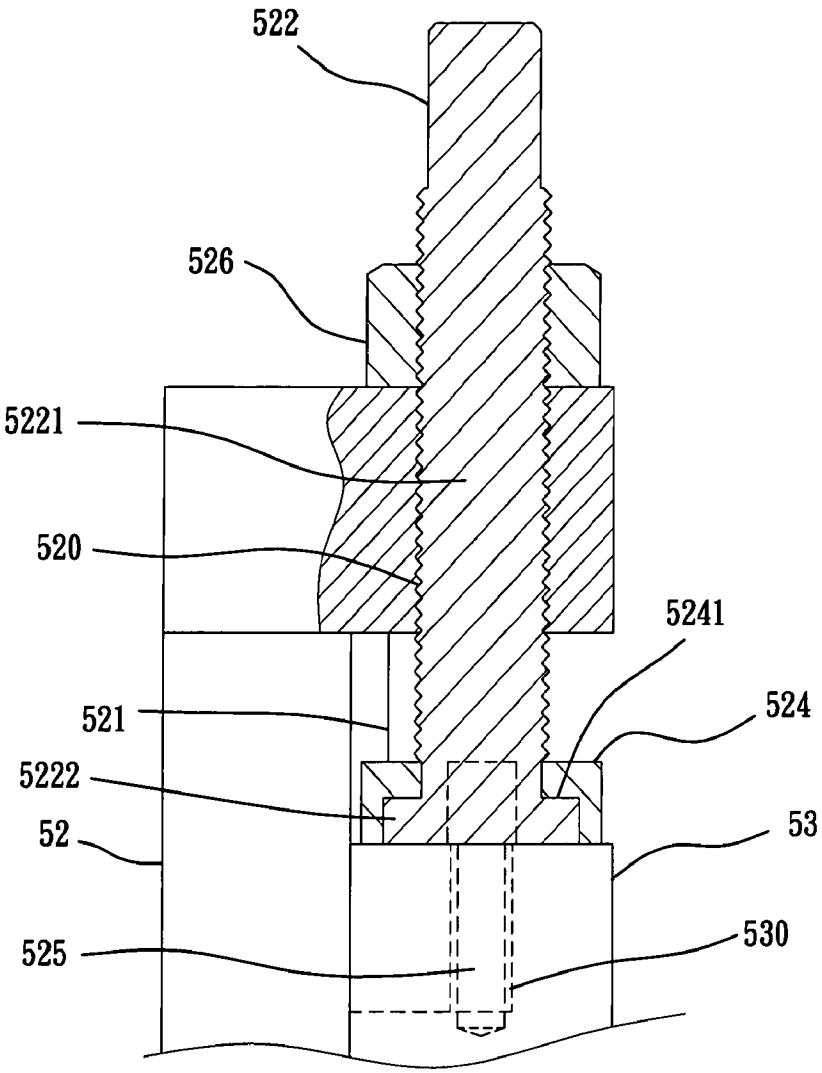
FIG. 18 is an enlarged view in section of a part of the present invention, showing the arrangement of the upper wheel holder of one second auxiliary shape-forming wheel set.
Figure 19:
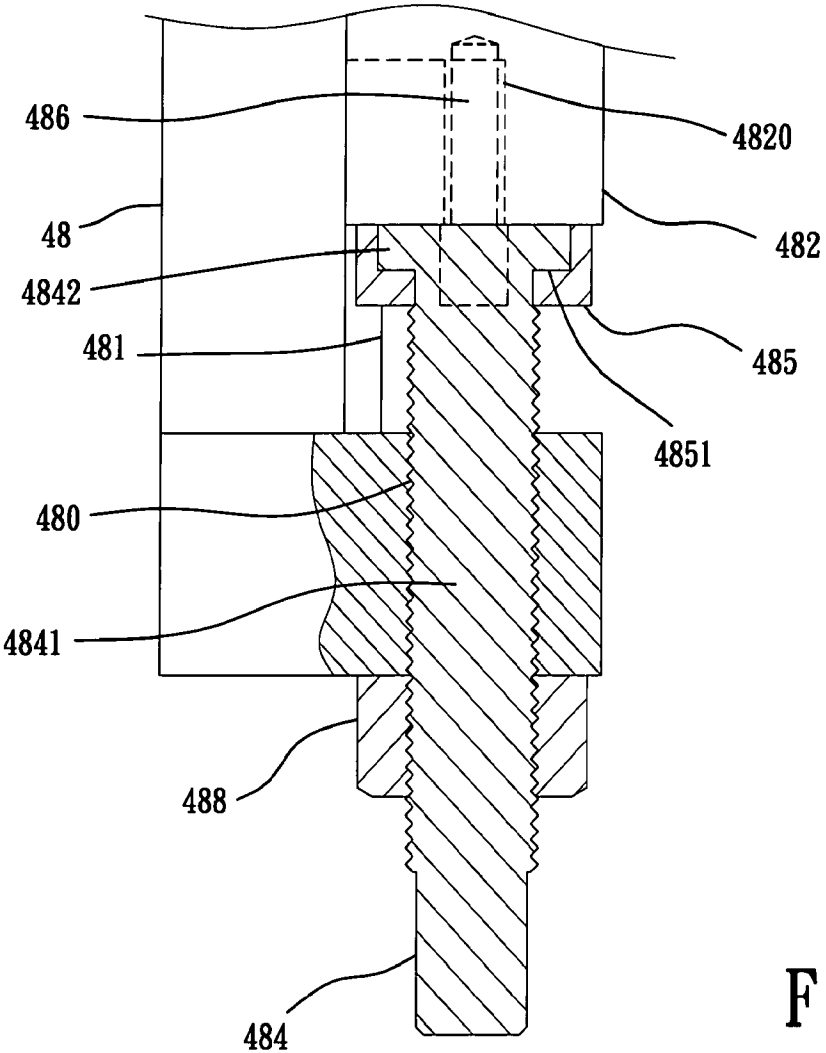
FIG. 19 is an enlarged view in section of a part of the present invention, showing the arrangement of the bottom wheel holder of one fist auxiliary shape-forming wheel set.
Figure 20:
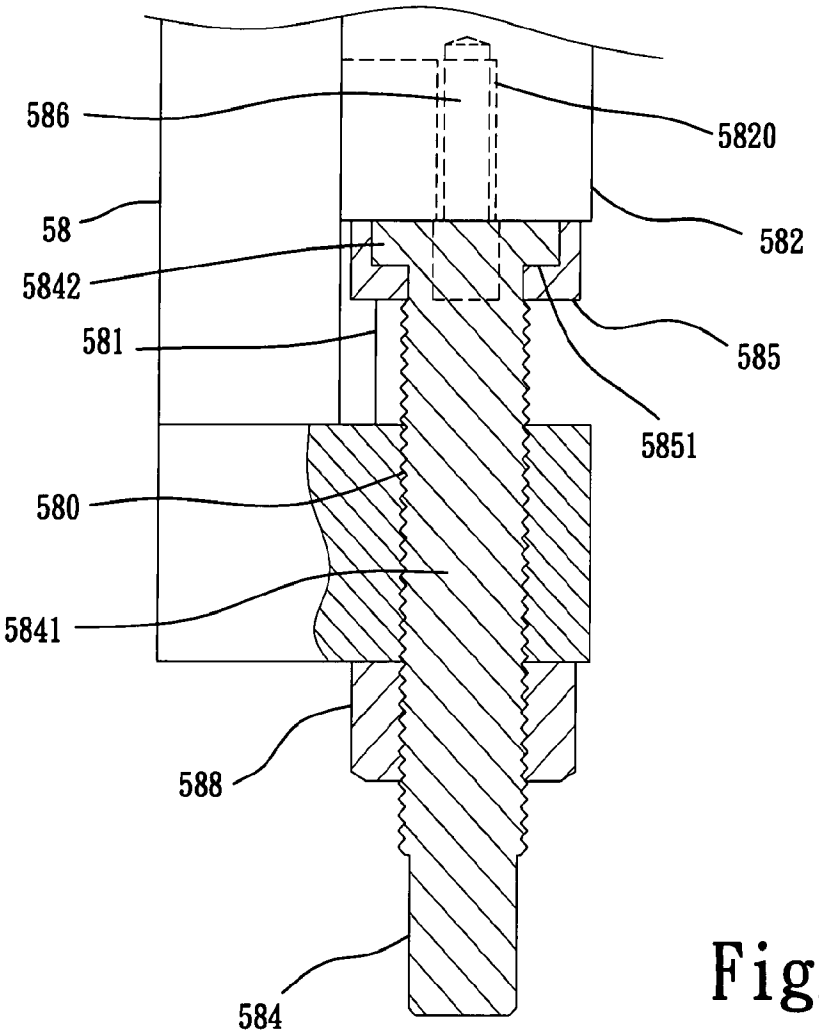
FIG. 20 is an enlarged view in section of a part of the present invention, showing the arrangement of the bottom wheel holder of one second auxiliary shape-forming wheel set.

Each second auxiliary shape-forming wheel set 5 further comprises a bottom wheel holder 58 (see FIGS. 12~16) provided at the lower part of the rack 51, a second bottom auxiliary wheel 59 pivoted to the bottom wheel holder 58 for working with the lower part 562 of the flat work surface 561 of the lateral shape-forming wheel 56 to ram each of two sides of a Z-shaped component 72 into a 90° contained angle (see FIGS. 15 and 16).

Figure 7:
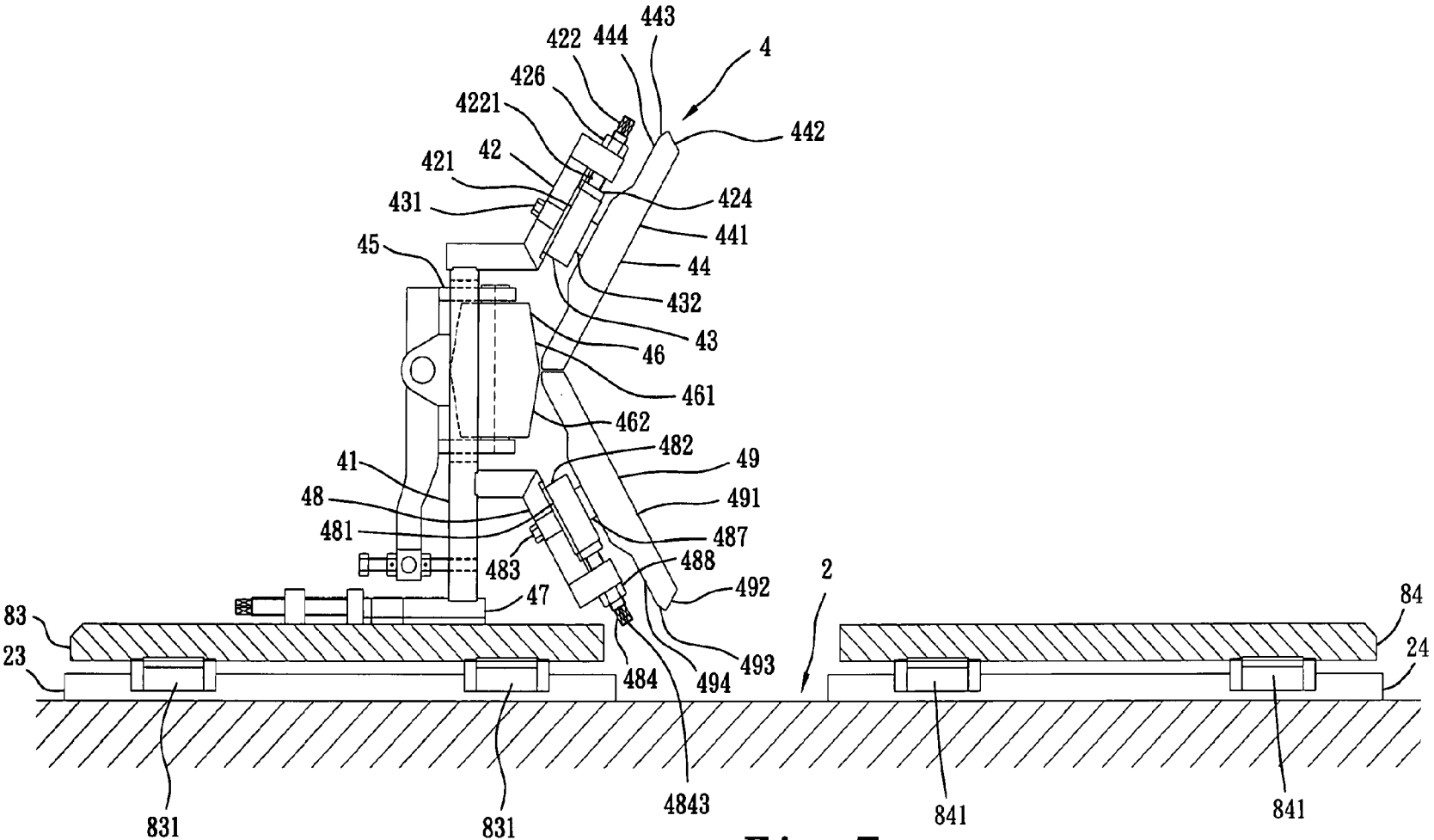
FIG. 7 is an enlarged view of a part of the roll-forming machine according to the present invention, showing the arrangement of one first auxiliary shape-forming wheel set.
Figure 8:
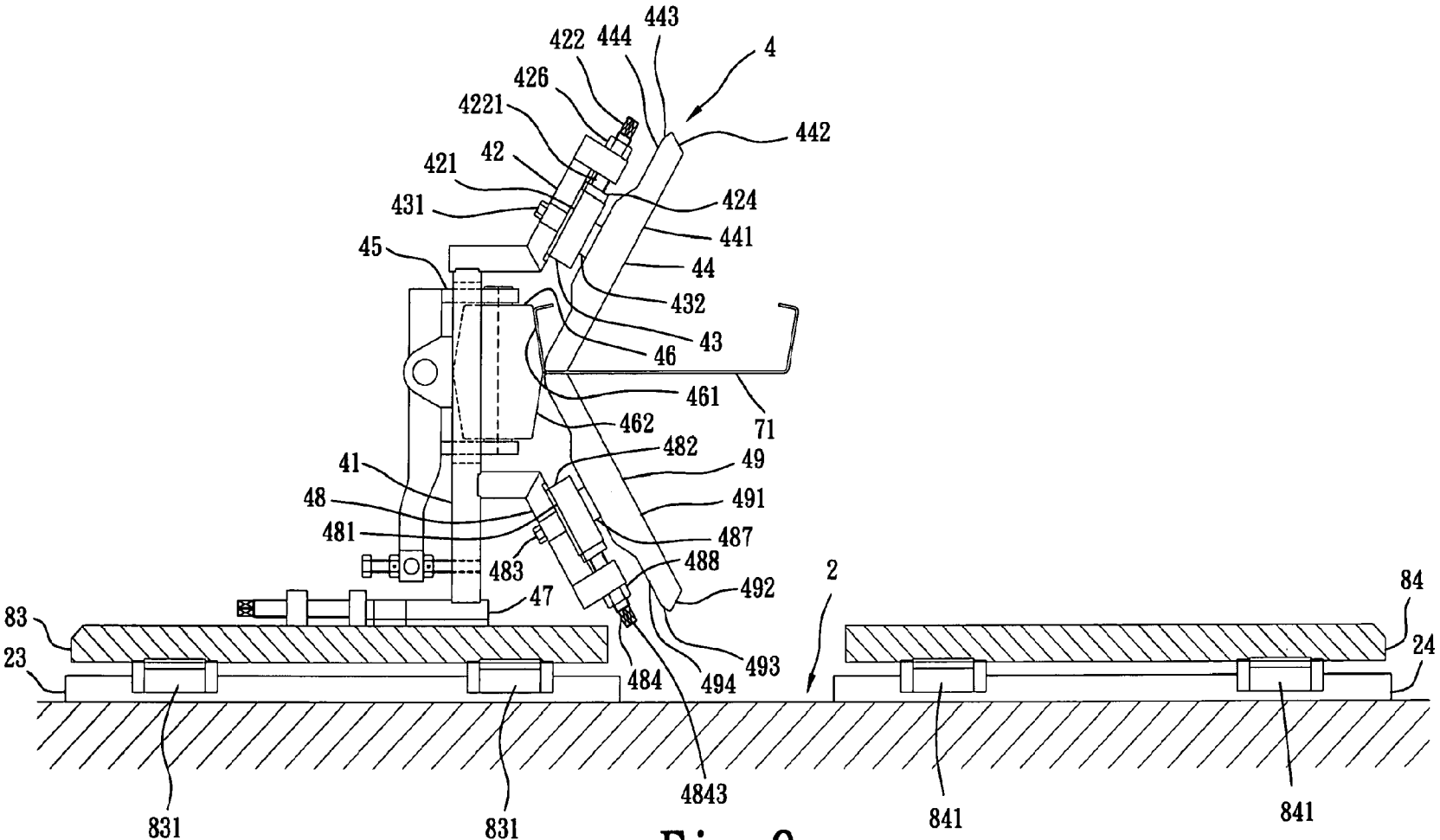
FIG. 8 corresponds to FIG. 7, showing one operation status of the first auxiliary shape-forming wheel set.
Figure 9:
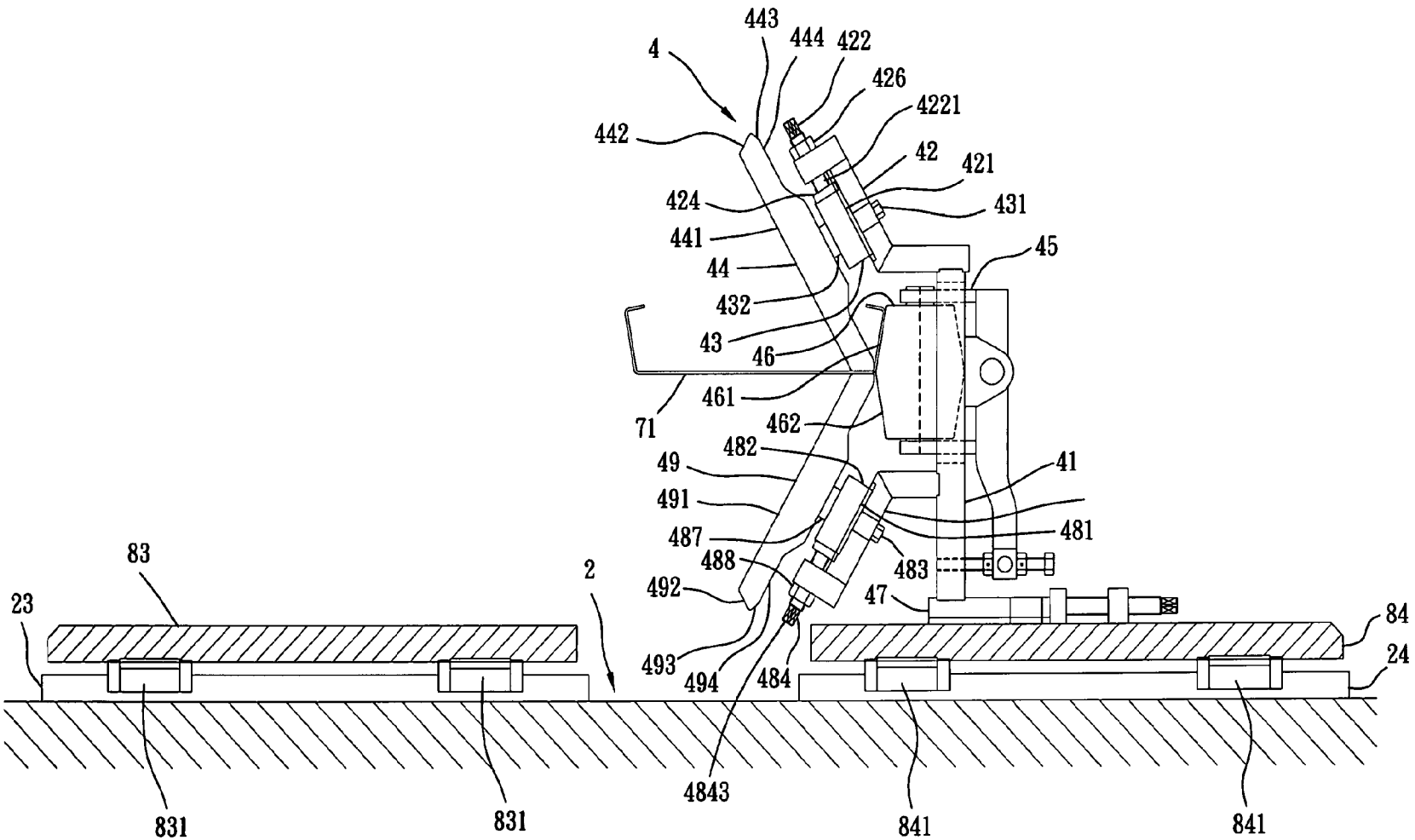
FIG. 9 is an enlarged view of a part of the roll-forming machine according to the present invention, showing the arrangement of the other first auxiliary shape-forming wheel set.

Further, as shown in FIG. 7, each first auxiliary shape-forming wheel set 4 further comprises a sliding block 482 pivoted to the first bottom auxiliary wheel 49 by a pivot 487 (see FIG. 7) and slidably coupled to a sliding groove 481 on the bottom wheel holder 48, a lock screw 483 for locking the sliding block 482 to the bottom wheel holder 48 (see FIG. 19), a connection block 485, which is fastened to a screw hole 4820 on one side of the sliding block 482 with a screw bolt 486 and defines therein a locating groove 4851, an adjustment screw 484, which has a threaded shank 4841 threaded into the screw hole 480 on the bottom wheel holder 48 and a head 4842 positioned in the locating groove 4851 of the connection block 485, and a nut 488 threaded onto the threaded shank threaded shank 4841 of the adjustment screw 484 to secure the adjustment screw 484 to the bottom wheel holder 48. When unfastened the lock screw 483, the user can rotate the adjustment screw 484 to move the sliding block 482 along the sliding groove 481 to the desired position. Further, the outer end 4843 of the adjustment screw 484 is coupled to a motor (not shown) that is controllable to rotate the adjustment screw 484 and to further move the connection block 485 and the sliding block 482 in the sliding groove 481 of the bottom wheel holder 48. The first bottom auxiliary wheel 49 has a flat circular bottom surface 491, a beveled peripheral surface 492 extending around the border of the flat circular bottom surface 491, a flat annular top surface 494, a chamfered annular surface 493 connected between the beveled peripheral surface 492 and the flat annular top surface 494 (see FIG. 7).

Figure 12:
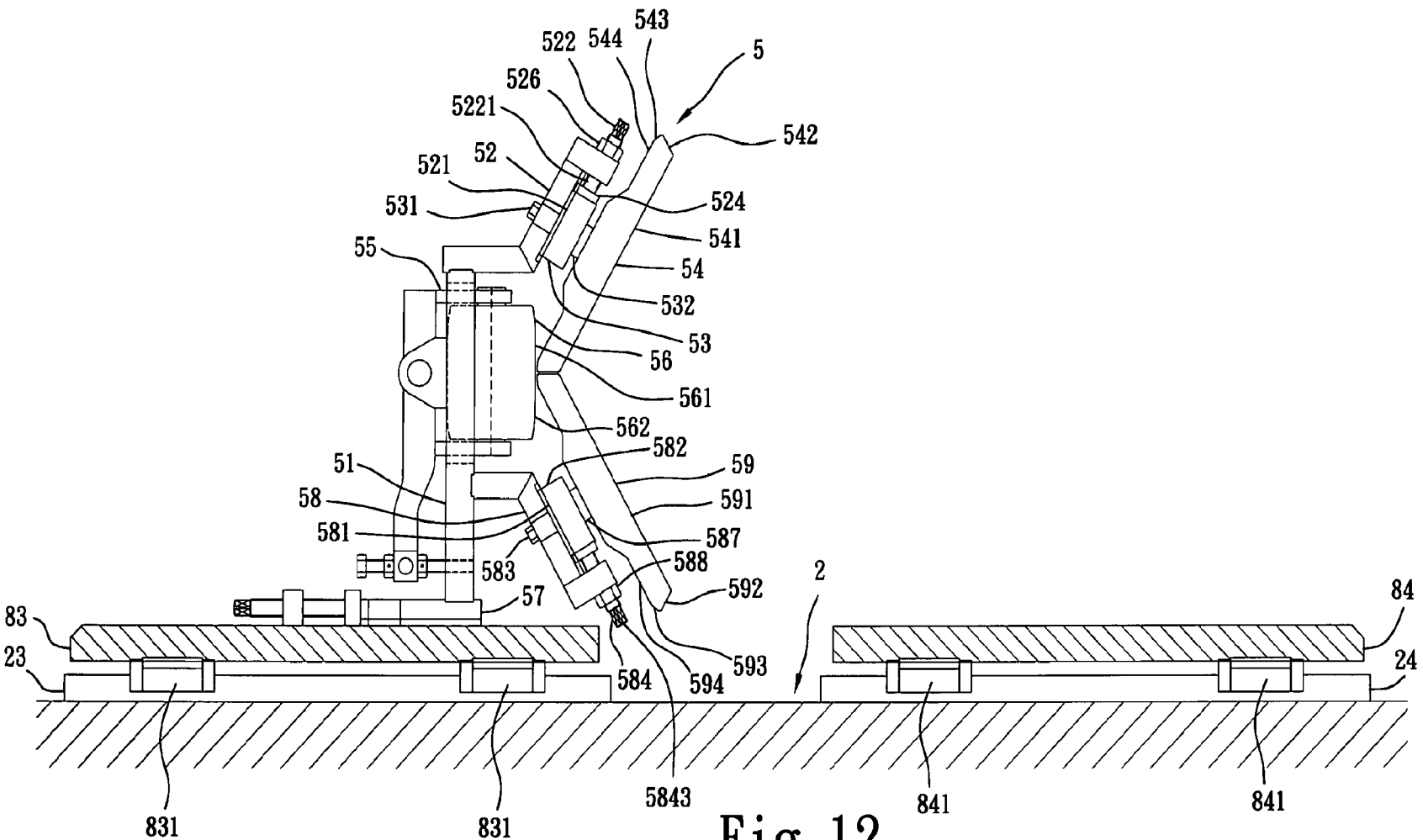
FIG. 12 is an enlarged view of a part of the roll-forming machine according to the present invention, showing the arrangement of one second auxiliary shape-forming wheel set.
Figure 13:
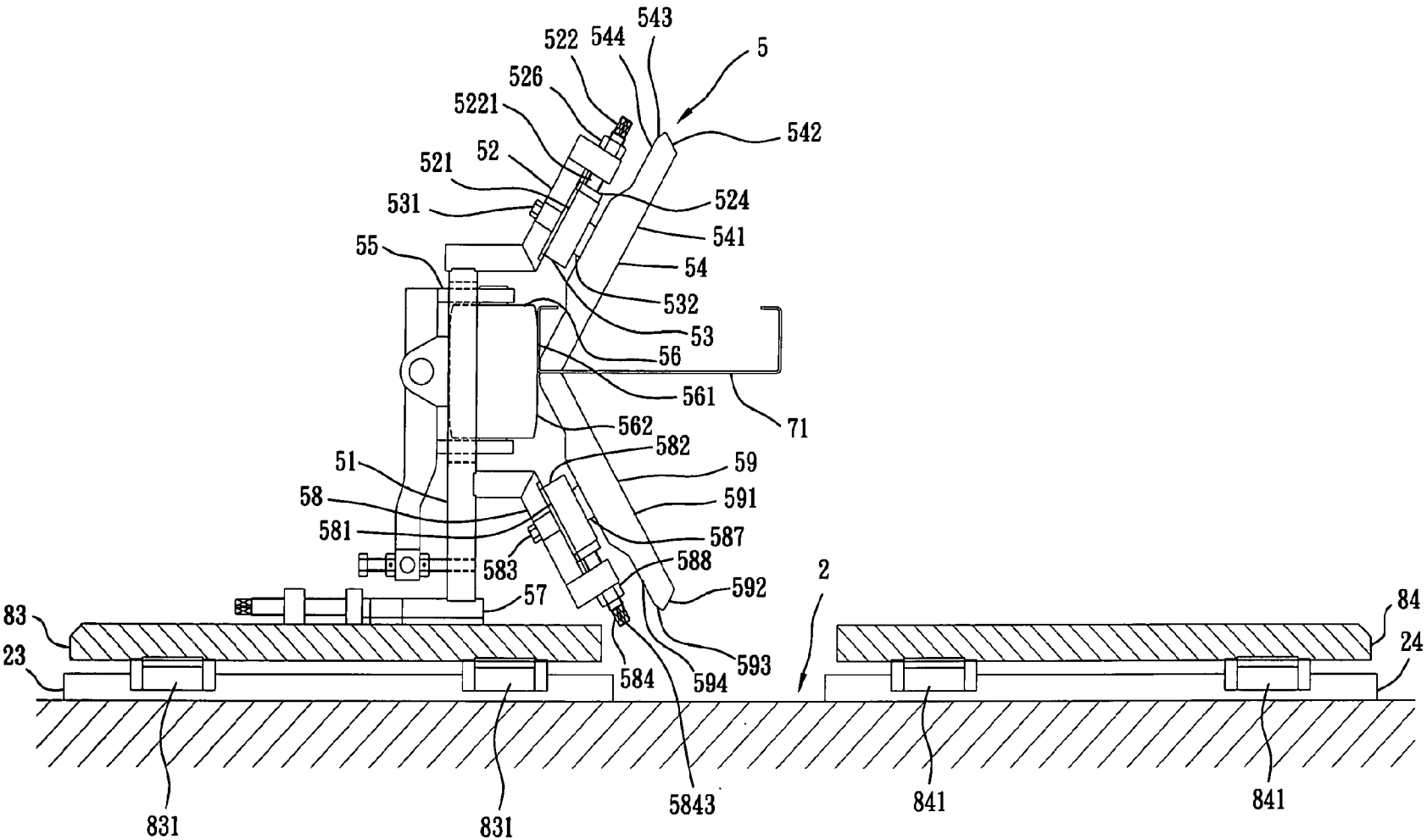
FIG. 13 corresponds to FIG. 12, showing an operation status of the second auxiliary shape-forming wheel set.
Figure 14:
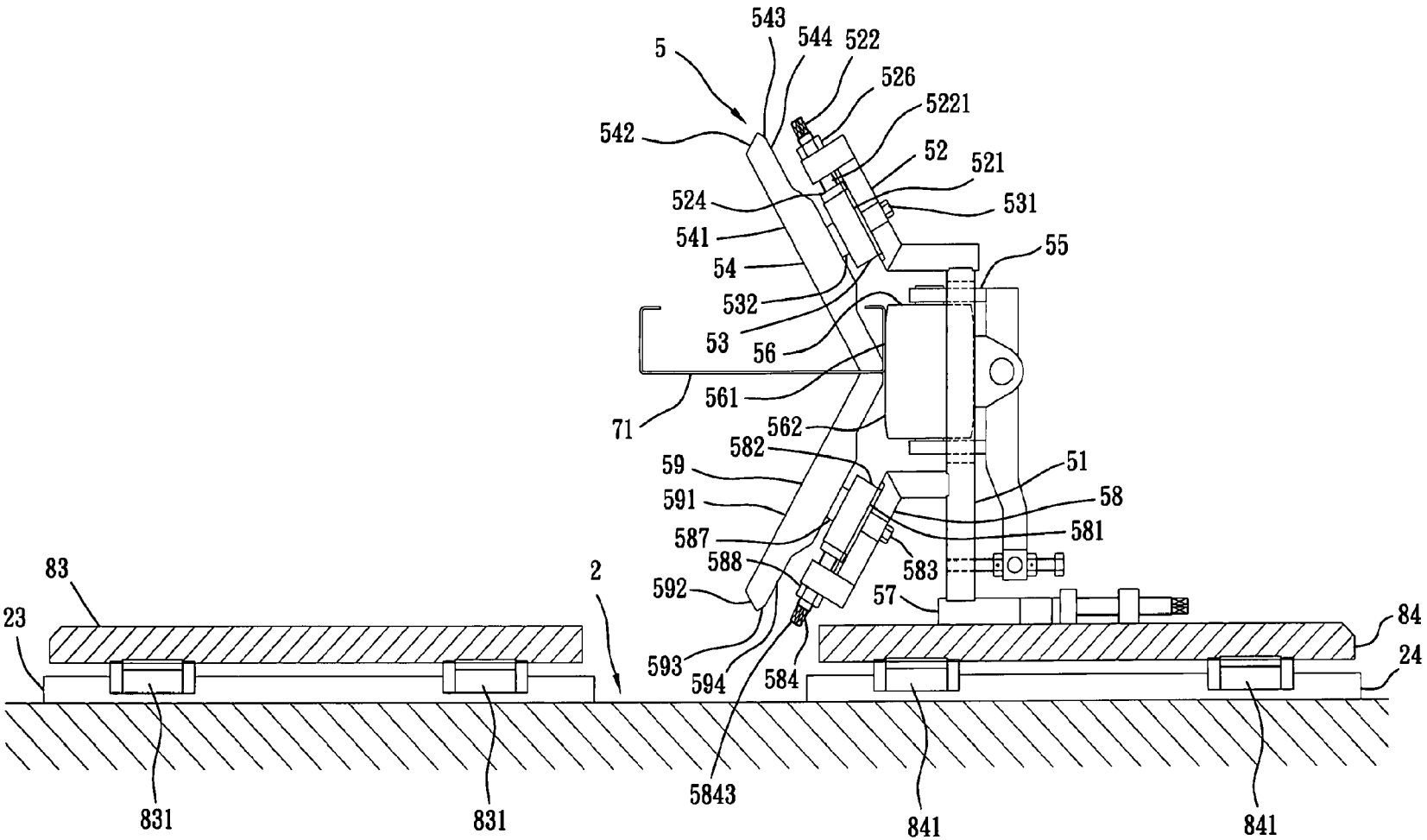
FIG. 14 is an enlarged view of a part of the roll-forming machine according to the present invention, showing one operation status of the other second auxiliary shape-forming wheel set.

Further, as shown in FIG. 12, each second auxiliary shape-forming wheel set 5 further comprises a sliding block 582 pivoted to the first bottom auxiliary wheel 59 by a pivot 587 (see FIG. 12) and slidably coupled to a sliding groove 581 on the bottom wheel holder 58, a lock screw 583 for locking the sliding block 582 to the bottom wheel holder 58 (see FIG. 20), a connection block 585, which is fastened to a screw hole 5820 on one side of the sliding block 582 with a screw bolt 586 and defines therein a locating groove 5851, an adjustment screw 584, which has a threaded shank 5841 threaded into the screw hole 580 on the bottom wheel holder 58 and a head 5842 positioned in the locating groove 5851 of the connection block 585, and a nut 588 threaded onto the threaded shank threaded shank 5841 of the adjustment screw 584 to secure the adjustment screw 584 to the bottom wheel holder 58. When unfastened the lock screw 583, the user can rotate the adjustment screw 584 to move the sliding block 582 along the sliding groove 581 to the desired position. Further, the outer end 5843 of the adjustment screw 584 is coupled to a motor (not shown) that is controllable to rotate the adjustment screw 584 and to further move the connection block 585 and the sliding block 582 in the sliding groove 581 of the bottom wheel holder 58. The second bottom auxiliary wheel 59 has a flat circular bottom surface 591, a beveled peripheral surface 592 extending around the border of the flat circular bottom surface 591, a flat annular top surface 594, a chamfered annular surface 593 connected between the beveled peripheral surface 592 and the flat annular top surface 594 (see FIG. 12).

As indicated above, the invention provides a roll-forming machine, which has the following advantages:

1. Except one upper auxiliary shape-forming wheel 44 and one lateral shape-forming wheel 46, the rack 41 of each first auxiliary shape-forming wheel set 4 has also mounted thereon a first bottom auxiliary wheel 49 for ramming each of the two sides of a C-shaped component 71 or Z-shaped component 72 into a 90° contained angle (see FIGS. 8~10).

2. When changing the processing from a C-shaped component processing mode to a Z-shaped component processing mode or from a Z-shaped component processing mode to a C-shaped component processing mode, the operator needs not to shut down the machine and to change a different specification of first auxiliary shape-forming wheel sets 4 or adjust the angle of the upper auxiliary shape-forming wheel 44 of each first auxiliary shape-forming wheel set 4. Therefore, the roll-forming machine is easy to operate and practical for mass production.

3. Except one upper auxiliary shape-forming wheel 54 and one lateral shape-forming wheel 56, the rack 51 of each second auxiliary shape-forming wheel set 5 has also mounted thereon a second bottom auxiliary wheel 59 for ramming each of the two sides of a C-shaped component 71 or Z-shaped component 72 into a 90° contained angle (see FIGS. 13~16).

4. When changing the processing from a C-shaped component processing mode to a Z-shaped component processing mode or from a Z-shaped component processing mode to a C-shaped component processing mode, the operator needs not to shut down the machine and then change a different specification of second auxiliary shape-forming wheel sets 5 or adjust the angle of the upper auxiliary shape-forming wheel 54 of each second auxiliary shape-forming wheel set 5. Therefore, the roll-forming machine is easy to operate and practical for mass production.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A roll-forming machine comprising: a a machine base, said machine base comprising a guide block unit provided at a front side thereof for guiding in a sheet material for processing;

a first left-side carrier plate, a second left-side carrier plate, a first right-side carrier plate and a second right-side carrier plate, said first left-side carrier plate and said first right-side carrier plate each having a respective bottom side respectively mounted with a respective slide, the slides at the bottom side of each of first left-side carrier plate and said first right-side carrier plate being respectively coupled to a left-side rail and a right-side rail at a top side of said machine base, said second left-side carrier plate and said second right-side carrier plate each having a respective bottom side respectively mounted with a respective slide, the slides at the bottom side of each of second left-side carrier plate and said second right-side carrier plate being respectively coupled to a left-side rail and a right-side rail at a rear side of said machine base;

pairs of forming roll sets for selectively processing said sheet material into a shape selected from a group consisting of C-shaped components and Z-shaped components, each said forming roll set comprising a rack, a first shaft and a second shaft pivotally mounted in the rack in horizontal at different elevations, an impression wheel fixedly mounted on one end of said first shaft, a first gear wheel fixedly mounted on an opposite end of said first shaft, a sheet-transfer wheel fixedly mounted on one end of said second shaft corresponding to said impression wheel, a second gear wheel fixedly mounted on an opposite end of said second shaft and meshed with said first gear wheel, a shape-forming wheel, which has a wheel shaft pivotally mounted in a wheel holder at said rack and is adapted to ram a sheet material being delivered through the gap between said impression wheel and said sheet-transfer wheel into a predetermined shape, a reduction gear box, and a coupling coupled between an output side of said reduction gear box and said second shaft, the racks of said pairs of forming roll sets being respectively mounted on said first left-side carrier plate, said second left-side carrier plate, said first right-side carrier plate and said second right-side carrier plate;

two motors adapted to drive said reduction gearboxes of said forming roll sets;

two first auxiliary shape-forming wheel sets respectively mounted on said second left-side carrier plate and said second right-side carrier plate at said machine base between two pairs of said pairs of forming roll sets near the rear side of said machine base, each said first auxiliary shape-forming wheel sets comprising a rack, an upper wheel holder provided at a top side of the rack of the respective first auxiliary shape-forming wheel set and having a sliding groove and a screw hole, a sliding block slidably coupled to the sliding groove of the upper wheel holder of the respective first auxiliary shape-forming wheel set, a lock screw for locking the sliding block of the respective first auxiliary shape-forming wheel set to the upper wheel holder of the respective first auxiliary shape-forming wheel set, a connection block fastened to a screw hole on one side of the sliding block of the respective first auxiliary shape-forming wheel set with a screw bolt and defining therein a locating groove, an adjustment screw, which has a threaded shank threaded into the screw hole of the respective first auxiliary shape-forming wheel set and a head positioned in the locating groove of the connection block of the respective first auxiliary shape-forming wheel set, and a nut threaded onto the threaded shank threaded shank of the adjustment screw of the respective first auxiliary shape-forming wheel set to secure the adjustment screw to the wheel holder of the respective first auxiliary shape-forming wheel set, an upper auxiliary shape-forming wheel that is pivoted to the sliding block of the respective first auxiliary shape-forming wheel set with a pivot, an adjustable lateral wheel holder provided laterally at the rack of the respective first auxiliary shape-forming wheel set, a lateral shape-forming wheel pivoted to the adjustable lateral wheel holder of the respective first auxiliary shape-forming wheel set, and a locating block fixedly provided at a bottom side of the rack of the respective first auxiliary shape-forming wheel set and affixed to one of said first left-side carrier plate and said second left-side carrier plate, the upper auxiliary shape-forming wheel of each said first auxiliary shape-forming wheel set having a flat circular bottom surface, a beveled peripheral surface extending around the flat circular bottom surface of the respective upper auxiliary shape-forming wheel, a flat annular top surface, a chamfered annular surface connected between the beveled peripheral surface and flat annular top surface of the respective upper auxiliary shape-forming wheel, the lateral shape-forming wheel of each said first auxiliary shape-forming wheel set having a conical work surface;

two second auxiliary shape-forming wheel sets respectively mounted on said second left-side carrier plate and said second right-side carrier plate at said machine base between two pairs of said pairs of forming roll sets near the rear side of said machine base, each said second auxiliary shape-forming wheel sets comprising a rack, an upper wheel holder provided at a top side of the rack of the respective second auxiliary shape-forming wheel set and having a sliding groove and a screw hole, a sliding block slidably coupled to the sliding groove of the upper wheel holder of the respective second auxiliary shape-forming wheel set, a lock screw for locking the sliding block of the respective second auxiliary shape-forming wheel set to the upper wheel holder of the respective second auxiliary shape-forming wheel set, a connection block fastened to a screw hole on one side of the sliding block of the respective second auxiliary shape-forming wheel set with a screw bolt and defining therein a locating groove, an adjustment screw, which has a threaded shank threaded into the screw hole of the respective second auxiliary shape-forming wheel set and a head positioned in the locating groove of the connection block of the respective second auxiliary shape-forming wheel set, and a nut threaded onto the threaded shank threaded shank of the adjustment screw of the respective second auxiliary shape-forming wheel set to secure the adjustment screw to the wheel holder of the respective second auxiliary shape-forming wheel set, an upper auxiliary shape-forming wheel that is pivoted to the sliding block of the respective second auxiliary shape-forming wheel set with a pivot, an adjustable lateral wheel holder provided laterally at the rack of the respective second auxiliary shape-forming wheel set, a lateral shape-forming wheel pivoted to the adjustable lateral wheel holder of the respective second auxiliary shape-forming wheel set, and a locating block fixedly provided at a bottom side of the rack of the respective second auxiliary shape-forming wheel set and affixed to one of said first left-side carrier plate and said second left-side carrier plate, the upper auxiliary shape-forming wheel of each said second auxiliary shape-forming wheel set having a flat circular bottom surface, a beveled peripheral surface extending around the flat circular bottom surface of the respective upper auxiliary shape-forming wheel, a flat annular top surface, a chamfered annular surface connected between the beveled peripheral surface and flat annular top surface of the respective upper auxiliary shape-forming wheel, the lateral shape-forming wheel of each said second auxiliary shape-forming wheel set having a conical work surface;

straightener means mounted on said machine base and adapted to straighten the wall of each C-shaped component and Z-shaped component been processed by said pairs of forming roll sets;

wherein:

each said first auxiliary shape-forming wheel set further comprises a bottom wheel holder provided at a lower part of the rack of the respective first auxiliary shape-forming wheel set, a first bottom auxiliary wheel pivoted to the bottom wheel holder of the respective first auxiliary shape-forming wheel set for working with a lower part of the conical work surface of the lateral shape-forming wheel of the respective first auxiliary shape-forming wheel set to ram each of two sides of a Z-shaped component into a 90° contained angle;

each said second auxiliary shape-forming wheel set further comprises a bottom wheel holder provided at a lower part of the rack of the respective second auxiliary shape-forming wheel set, a second bottom auxiliary wheel pivoted to the bottom wheel holder of the respective second auxiliary shape-forming wheel set for working with a lower part of the conical work surface of the lateral shape-forming wheel of the respective second auxiliary shape-forming wheel set to ram each of two sides of a Z-shaped component into a 90° contained angle.

2. The roll-forming machine as claimed in claim 1, wherein each said first auxiliary shape-forming wheel set further comprises a sliding block pivoted to the respective first bottom auxiliary wheel by a pivot and slidably coupled to a sliding groove on the respective bottom wheel holder.

3. The roll-forming machine as claimed in claim 2, wherein each said first auxiliary shape-forming wheel set further comprises a lock screw for locking the respective sliding block to the respective bottom wheel holder, a connection block, which is fastened to a screw hole on one side of the respective sliding block with a screw bolt and defines therein a locating groove, an adjustment screw, which has a threaded shank threaded into the screw hole on the respective bottom wheel holder and a head positioned in the locating groove of the respective connection block, and a nut threaded onto the threaded shank threaded shank of the respective adjustment screw to secure the respective adjustment screw to the respective bottom wheel holder.

4. The roll-forming machine as claimed in claim 3, wherein the adjustment screw that is threaded into the screw hole on the bottom wheel holder of the respective first auxiliary shape-forming wheel set has an outer end coupled to a motor for synchronous rotation with the motor.

5. The roll-forming machine as claimed in claim 1, wherein said first bottom auxiliary wheel has a flat circular bottom surface, a beveled peripheral surface extending around the border of the flat circular bottom surface of said first bottom auxiliary wheel, a flat annular top surface, a chamfered annular surface connected between the beveled peripheral surface and flat annular top surface of said first bottom auxiliary wheel.

6. The roll-forming machine as claimed in claim 1, wherein each said second auxiliary shape-forming wheel set further comprises a sliding block pivoted to the respective first bottom auxiliary wheel by a pivot and slidably coupled to a sliding groove on the respective bottom wheel holder.

7. The roll-forming machine as claimed in claim 6, wherein each said second auxiliary shape-forming wheel set further comprises a lock screw for locking the respective sliding block to the respective bottom wheel holder, a connection block, which is fastened to a screw hole on one side of the respective sliding block with a screw bolt and defines therein a locating groove, an adjustment screw, which has a threaded shank threaded into the screw hole on the respective bottom wheel holder and a head positioned in the locating groove of the respective connection block, and a nut threaded onto the threaded shank threaded shank of the respective adjustment screw to secure the respective adjustment screw to the respective bottom wheel holder.

8. The roll-forming machine as claimed in claim 7, wherein the adjustment screw that is threaded into the screw hole on the bottom wheel holder of the respective second auxiliary shape-forming wheel set has an outer end coupled to a motor for synchronous rotation with the motor.

9. The roll-forming machine as claimed in claim 1, wherein said second bottom auxiliary wheel has a flat circular bottom surface, a beveled peripheral surface extending around the border of the flat circular bottom surface of said second bottom auxiliary wheel, a flat annular top surface, a chamfered annular surface connected between the beveled peripheral surface and flat annular top surface of said second bottom auxiliary wheel.

* * * * *